US007341247B2

(12) United States Patent
Hirata et al.

(10) Patent No.: US 7,341,247 B2
(45) Date of Patent: Mar. 11, 2008

(54) IMAGE FORMING APPARATUS

(75) Inventors: Tetsuo Hirata, Hachioji (JP); Motoki Nakamichi, Hachioji (JP); Eiji Anzai, Hachioji (JP); Norishige Kato, Hachioji (JP); Takehiro Ogushi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 215 days.

(21) Appl. No.: 10/892,004

(22) Filed: Jul. 14, 2004

(65) Prior Publication Data

US 2005/0017426 A1 Jan. 27, 2005

(30) Foreign Application Priority Data

Jul. 22, 2003 (JP) ..... 2003-199689
Apr. 28, 2004 (JP) ..... 2004-133889

(51) Int. Cl.
*B65H 37/04* (2006.01)

(52) U.S. Cl. ..... 270/58.07; 270/58.08; 270/58.09; 399/407

(58) Field of Classification Search ..... 270/58.07, 270/58.08, 58.09; 399/407
See application file for complete search history.

(56) References Cited

U.S. PATENT DOCUMENTS 5,592,881 A * 1/1997 Rabjohns ..... 101/483
6,176,480 B1 * 1/2001 Yonenuma et al. ..... 270/58.08
7,017,902 B2 * 3/2006 Kuru et al. ..... 271/258.02
2003/0168796 A1 * 9/2003 Suzuki et al. ..... 270/58.07
2003/0198494 A1 * 10/2003 Kenji et al. ..... 399/381

FOREIGN PATENT DOCUMENTS

JP 09071351 A * 3/1997
JP 2000-263889 A 9/2000
JP 2000-263898 A 9/2000
JP 2001-265561 A 9/2001

* cited by examiner

*Primary Examiner*—Gene O. Crawford
*Assistant Examiner*—Leslie A Nicholson, III
(74) *Attorney, Agent, or Firm*—Frishauf, Holtz, Goodman & Chick, P.C.

(57) ABSTRACT

An image forming apparatus includes an image forming member to form an image to an recording material, a plurality of sheet finisher units, each of which performs different sheet finishing to the recording material on which the image has formed, a plurality of indicating member provided respectively at least one to the each sheet finisher unit, an input member to accept an input of a sheet finishing mode corresponding to the sheet finishing performed by the sheet finisher unit, a sheet finishing judging member to judge the sheet finisher unit performing the sheet finishing corresponding to the input sheet finishing mode, and an indicating control member to light the indicating member provided to the judged sheet finisher unit in a first display mode.

17 Claims, 16 Drawing Sheets

FOLDING-IN

FOLDING-OUT

LETTER FOLD-IN

LETTER FOLD-OUT

DOUBLE PARALLEL FOLDING

Z FOLDING

DOUBLE GATE FOLDING

MULTI FOLDING +
SADDLE STITCHING +
SIDE STITCHING

MULTI FOLDING +
SIDE STITCHING

SIDE STITCHING

MULTI FOLDING +
SADDLE STITCHING

STACKER +
STACKER +
SIDE STITCHING

STACKER +
SIDE STITCHING

STACKER +
STACKER

IMAGE FORMING APPARATUS

BACKGROUND OF THE INVENTION

1. Field of the Invention

The present invention is related to an image forming apparatus giving a sheet finishing to printed matter where an image has been formed.

2. Description of Related Art

Complex machines based on a copying machine further having functions of such as a printer, facsimile and the like are in widespread use. These complex machines have various functions based on intended purposes in order to fulfill user's various requests in recent years. For example, known is an image forming apparatus having a sheet finisher unit for giving a sheet finishing such as side stitching, saddle stitching, various folding, punching and the like to printed matter where an image has been formed. Such sheet finisher units have a plurality of sheet ejection trays, and printed matter processed by various functions is ejected to a sheet ejection tray corresponding to each type of process.

Among an image forming apparatus having a multifunctional sheet finisher unit, known is an image forming apparatus where a schedule of jobs is managed according to a function of the sheet finisher unit so as to improve a productivity thereof (for example, see JP Tokukai 2000-263898A). Among an image forming apparatus having a plurality of sheet ejection tray, known is an image forming apparatus where an informing member is provided at a vicinity of the sheet ejection trays so as to be capable of informing a completion of sheet ejection (for example, see JP Tokukai 2000-263889A). Among an image forming apparatus having a plurality of output bins, known is an output bin managing apparatus for indicating the output bin which has output a printing job in a recognizable manner by judging an output a recording material according to a destination of a printing job (for example JP Tokukai 2001-265561A).

However, though the above-described image forming apparatuses perform an optimal schedule management according to a function of the sheet finisher unit, they do not clearly indicate a sheet ejection tray where managed printed matter is to be ejected. That is, according to the image forming apparatuses in earlier development, printed matter where various sheet finishing is performed is ejected to individual sheet ejection trays which are different from one another corresponding to the given treatment. Thus, it has been impossible for a user to know the sheet ejection tray by himself, where a printed matter output is to be ejected, since the apparatuses do not have a constitution for showing the sheet ejection tray clearly. For this reason, when a large amount of printed matter is ejected, it has been problematic that a destination of ejection position of a desired printed matter becomes uncertain.

Further, a high-capacity sheet ejection tray (stacker) is provided to a sheet finisher unit, some stackers have a door so that a user can not check an internal structure. Here, when the door of a stacker is opened or closed by accident, the process is interrupted by a safety function. That is, it has been problematic that a jam occurs and which results a degradation of processing efficiency.

In the above-described image forming apparatuses, since the sheet ejected at the last informs a certain sheet ejection tray, the sheet ejection tray is not informed until the process is completed. Thus, an ejected sheet is not collected effectively. Further, in the above-described output bin managing apparatus, an indicating member for indicating an output bin which is a destination of ejection according to a printing job is provided apart from the output bin. Therefore it has been problematic that the output bin where a sheet has ejected according to a printing job is not recognizable visually.

SUMMARY OF THE INVENTION

The object of the invention is to provide an image forming apparatus having a sheet finisher unit with a plurality of sheet ejection trays, where printed matter can be output in which the ejection position thereof is clear.

In order to solve the above problems, according to the first aspect of the invention, an image forming apparatus comprises a plurality of sheet finisher units each of which performs different sheet finishing to a recording material on which an image has formed, a plurality of indicating member provided respectively at least one to the each sheet finisher unit, an input member to accept an input of a sheet finishing mode corresponding to the sheet finishing performed by the sheet finisher unit, a sheet finishing judging member to judge the sheet finisher unit performing the sheet finishing corresponding to the input sheet finishing mode, and an indicating control member to light the indicating member provided to the judged sheet finisher unit in a first display mode.

According to the second aspect of the invention, an image forming apparatus comprises:

a sheet finisher unit to perform different sheet finishings corresponding to a plurality of sheet finishing modes to a recording material, a plurality of sheet ejection tray provided to the sheet finisher unit, to which a recording material performed the sheet finishing is ejected, a plurality of indicating members provided respectively at a vicinity of a plurality of the sheet ejection trays, an input member to accept an input of the sheet finishing mode corresponding to the sheet finishing performed by the sheet finisher unit, a sheet finishing judging member to judge the sheet ejection tray to which the recording material performed the sheet finishing corresponding to the input sheet finishing mode is to be ejected, and an indicating control member to light the indicating member provided at the vicinity of the sheet ejection tray judged by the sheet finishing judging member.

BRIEF DESCRIPTION OF THE DRAWINGS

The present invention will become more fully understood by the description and the accompanied drawings stated below. However, it is needless to say that the present invention is not limited thereto, and wherein.

PREFERRED EMBODIMENT OF THE INVENTION

Hereinafter, the present invention will be explained in detail with referring the drawings. However, a scope of the invention is not limited to the illustrated embodiments.

First, a constitution of an embodiment according to the present invention will be explained.

Figure 1:
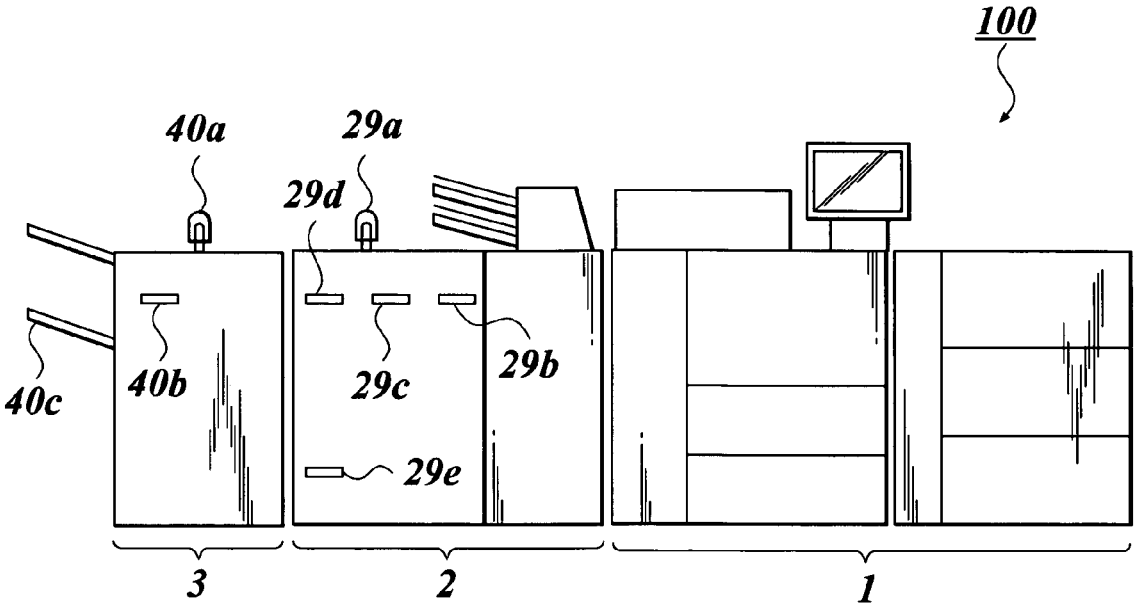
FIG. 1 shows an exterior constitution of an image forming apparatus in the embodiment applying the present invention, FIG. 2A to FIG. 2G explain folding processes performed by sheet finisher units 2 and 3.
Figure 2A:
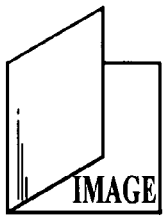
Figure 2B:
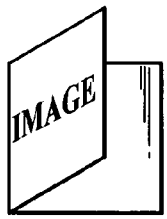
Figure 2C:
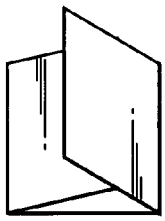
Figure 2D:
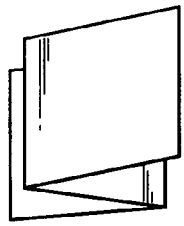
Figure 2E:
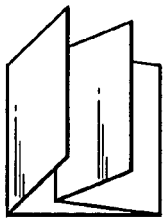
Figure 2F:
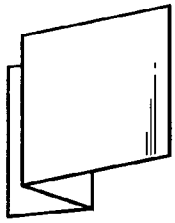
Figure 2G:
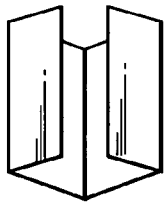
Figure 3A:
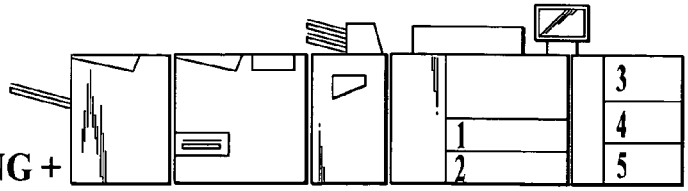
FIG. 3A to FIG. 3G show one of combination examples of the sheet finisher units in an image forming apparatus 100.
Figure 3B:
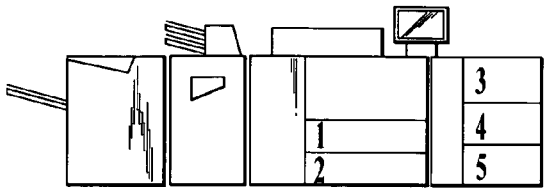
Figure 3C:
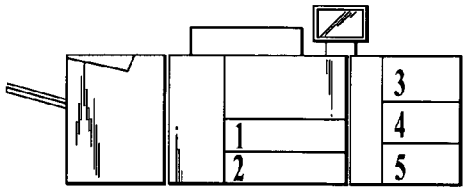
Figure 3D:
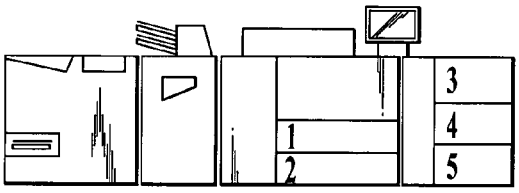
Figure 3E:
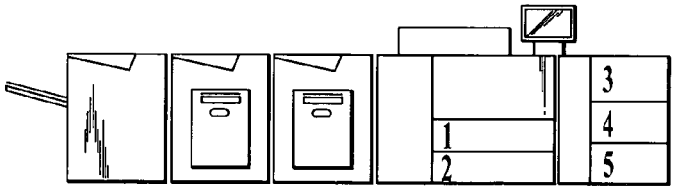
Figure 3F:
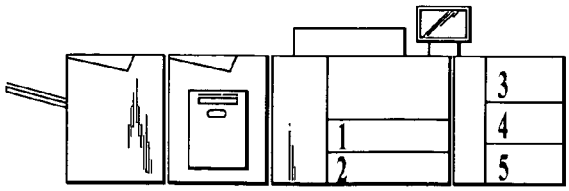
Figure 3G:
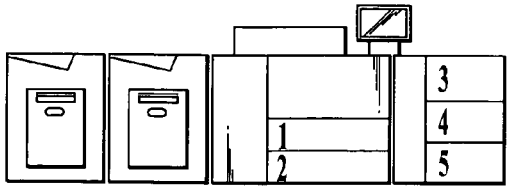

FIG. 1 shows an appearance constitution of the image forming system 100 according to the embodiment of the present invention. As shown in FIG. 1, the image forming system 100 is composed of the image forming unit 1, sheet finisher unit 2 and a sheet finisher unit 3. It is to be noted that the number of the sheet finisher units 2 and 3 which are connected to the one image forming unit 1 is not especially limited.

The image forming unit 1 forms an image to a recording material (hereinafter referred to as a "sheet") such as a sheet. The sheet finisher units 2 and 3 gives a sheet finishing to a sheet, to which the image forming unit 1 has formed an image, in accordance with various sheet finishing modes. For example, the sheet finisher units 2 and 3 comprise a multi folding unit having a multi folding mode, saddle stitching unit having a saddle stitching mode, side stitching unit having a side stitching mode, stacker unit having a stacking mode and the like, perform multi folding, saddle stitching, side stitching, stacking and the like to an image-formed sheet according to the direction of the image forming unit 1, and eject the sheets to a designated ejection tray. Concretely, the sheet finisher unit 2 is composed of a multi folding unit and saddle stitching unit, and the sheet finisher unit 3 is composed of a side stitching unit.

The sheet finisher units 2 and 3 comprises indicating members 29*a* and 40*a* for informing a sheet finisher unit to which a sheet performed a sheet finishing is ejected, and further comprises a plurality of sheet ejection trays where a sheet performed various sheet finishing is ejected. Further, indicating members 29*b* to 29*e*, 40*b* and 40*c* for informing an ejection position of a sheet are provided respectively at a vicinity of the sheet ejection trays.

Here, a folding process and stitching process corresponding to various sheet finishing modes are explained. FIGS. 2A to 2G explains the folding processes. As shown in FIGS. 2A to 2G, the folding processes includes folding-in, folding-out, letter fold-in, letter fold-out, double parallel folding, Z folding, double gate folding and the like. The stitching process includes a side stitching process and center stitching process, where the side stitching process is to staple stacked sheets at a designated positions (for example, one at the upper left, two at the left side, one at the upper right, two at the upper side), and the saddle stitching process is to staple stacked sheets at the center thereof for making a booklet.

Next, combination examples of the sheet finisher units provided to the image forming apparatus 100 are explained. As shown in FIGS. 3A to 3G, the image forming apparatus 100 can be combined with the sheet finisher units having various units. Further, it can be combined with a plurality of same units.

Figure 4:
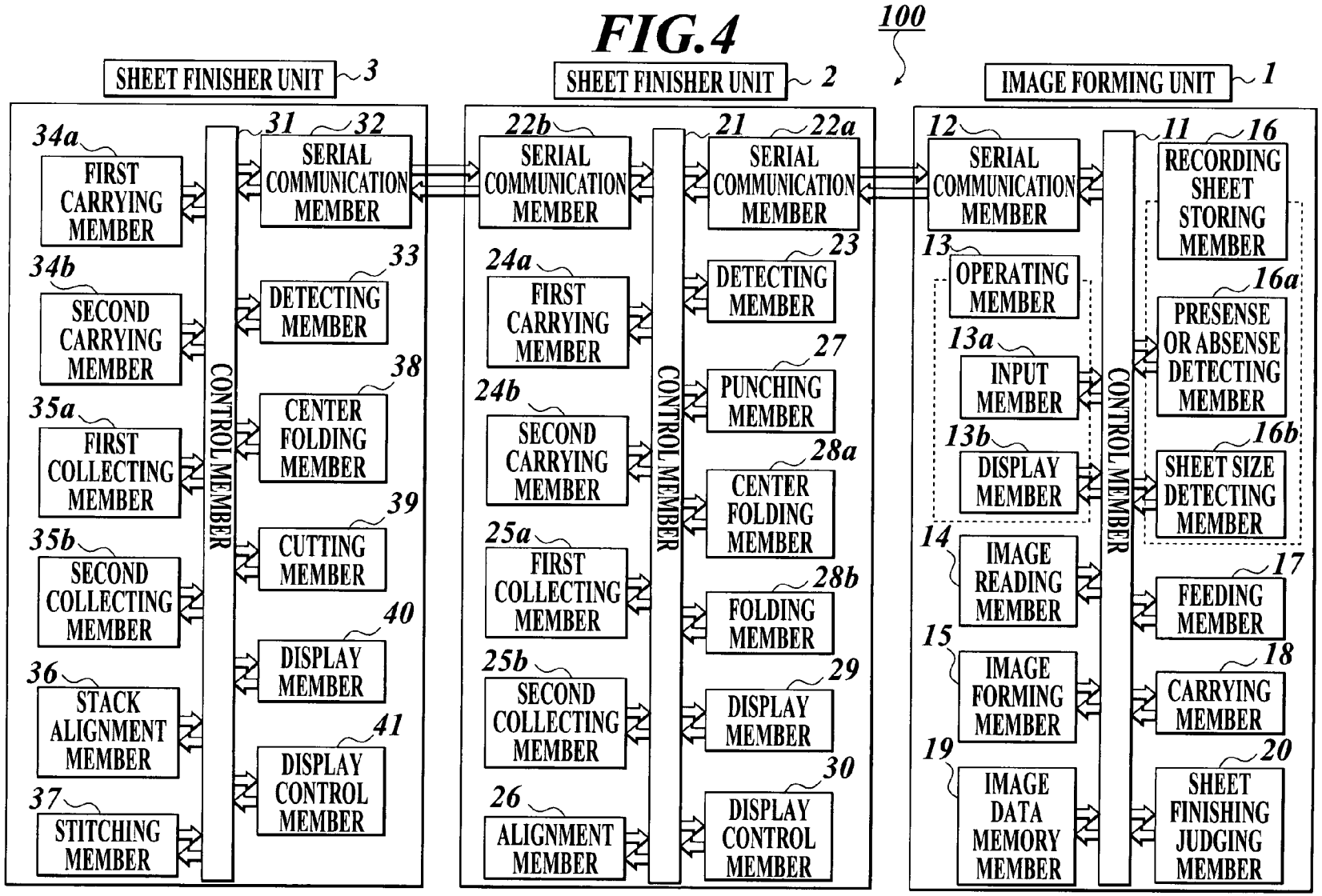
FIG. 4 shows functional constitutions of an image forming unit 1, sheet finisher unit 2 and sheet finisher unit 3.

Referring FIG. 4, a functional constitution of individual members of the image forming apparatus 100 will be explained. As shown in FIG. 4, the image forming apparatus 100 is composed where the image forming unit 1, sheet finisher unit 2 and sheet finisher unit 3 are connected with one another by serial communication so as to be capable of sending and receiving a data.

First, an internal constitution of the image forming unit 1 will be explained.

As shown in FIG. 4, the image forming unit 1 is composed of a control member 11, serial communication member 12, operation member 13, image reading member 14, image forming member 15, sheet housing member 16, feeding member 17, carrying member 18, image data memory member 19, sheet finishing judging member 20 and the like, where the individual members are connected with one another by bus.

The control member 11 is composed of a CPU (Central Processing Unit), ROM (Read Only Memory), RAM (Random Access Memory) and the like. According to a given operation to an input member 13*a*, the CPU of the control member 11 reads out a system program and various processing programs memorized in the ROM, develops thereof to the RAM, and operates individual parts of the image forming unit 1 according to the developed program by centralized control.

Between the sheet finisher unit 2 and the control member 21, the control member 11 sends control signals such as a copy start signal, sheet eject signal and the like to the sheet finisher unit 2, and receives sheet ejection counting, various warning information (opening of the door, rest of staples and sheets and the like), detected jam and the like, based on an operation of the image forming unit 1 according to a data sending and receiving sequence in copying operation. According to the received information, the control member 11 executes an ejection position indicating process (see FIG. 5) and a sheet finisher unit indicating process (see FIG. 6) for displaying information of the sheet finisher unit 2 on an indicating member 13*b* of the operation member 13, and an ejection tray selecting process (see FIG. 7) for lighting the indicating member of the sheet finisher unit. Each process will hereinafter be described in detail.

The serial communication member 12 is composed of a serial communication I/F and the like, and controls control signals sent and received by serial communication between the image forming unit 1 and the sheet finisher unit 2.

The operation member 13 is composed of the input member 13*a* and the indicating member 13*b*. The input member 13*a* is composed of a pressure-sensitive (resistive film type) touch panel in which transparent electrodes are arranged in a grid pattern on a display surface of LCD, and detects X-Y position of pressed point pressed by a finger, a touch-pen or the like, so as to output the detected position signal to the control member 11 as an control signal. The input member 13*a* is composed of various operating buttons such as a numeral button and a start button, and outputs a control signal to the control member 11 according to an operation of buttons. The indicating member 13*b* is composed of LCD (Liquid Crystal Display) and the like, and displays various operation buttons, status of the apparatus, operating condition of each function and the like according to the instructions of indicating signals input from the control member 11.

The image reading member 14 includes a scanner provided under a contact glass for placing a manuscript, and reads an image of the manuscript. The scanner is composed of a light source, a CCD (Charge Coupled Device) and the like, and reads an image of the manuscript by imaging reflected light of scanning light irradiated from a light source to a manuscript and performing a photoelectric conversion, and outputs the read image to the image forming member 15. It is to be noted here that the image is not limited to an image data such as figures, photographs and the like, but also comprises text data such as letters and marks.

The image forming member 15 is composed of a photoconductor drum, toner and the like, and forms an electro latent image of an image input from the image reading member 14 according to a print direction sent from the control member 11 to the photoconductor drum, when the carrying member 18 carries a sheet having a size and aspect input to the input member 11. Further, the toner is adhered to the specific region of surface of the photoconductor drum, where the region contains the electric latent image by the image forming member 15, and is transferred and fixed to a sheet and subsequently ejected the sheet finisher units 2 and 3.

The sheet housing member 16 houses a sheet to which an image is to be transferred. The sheet housing member 16 is composed of a presence detecting member 16*a* for detecting presence or absence of sheets, a paper size detecting member 16*b* for detecting a paper size, and outputs detected signals to the control member 11.

The feeding member 17 automatically feeds a manuscript placed on a manuscript setting position to a top surface of the contact glass according to a direction from the control member 11. The carrying member 18 carries a sheet housed in the sheet housing member 16 to various parts of the image forming member 15 and the like.

The image data memory member 19 is composed of a semiconductor memory (DRAM), magnetic disk (HDD) and the like, and is a memory for memorizing an image data read in by the image reading member 14.

The sheet finishing judging member 20 judges a sheet finisher unit for giving a sheet finishing to an image-formed sheet according to the sheet finishing mode input via the input member 13*a*, and outputs the judgment result to the control member 11.

Next, Internal constitution of the sheet finisher unit 2 will be explained.

As shown in FIG. 1, the sheet finisher unit 2 is composed of a control member 21, a serial communication member 22*a*, a serial communication member 22*b*, a detecting member 23, a first carrying member 24*a*, a second carrying member 24*b*, a first collecting member 25*a*, a second collecting member 25*b*, an alignment member 26, a punching member 27, a folding member 28, an indicating member 29 and the like, and the individual parts are connected to one another by bus.

The control member 21 is composed of a CPU, ROM, RAM and the like. The CPU of the control member 21 reads out a system program and various processing programs memorized in the ROM, develops thereof to the RAM, and operates individual parts of the sheet finisher unit 2 regarding to the developed program by a centralized control. The control member 21 sends and receives a control signal between the control member 11 of the image forming unit 1 and an after-mentioned control member 31 of the sheet finisher unit 3 by serial communication.

The serial communication member 22*a* is composed of a serial communication I/F and the like, and controls sending and receiving of control signals and an image data and the like of serial communication between the image forming unit 1 and the sheet finisher unit 2. The serial communication member 22*b* is composed of a serial I/F and the like, and controls sending and receiving of control signals and an image data and the like by serial communication, between the sheet finisher unit 2 and the sheet finisher unit 3.

The detecting member 23 is composed of an entrance detecting sensor, a bypass sensor, a passage detecting sensor, a sheet ejection sensor and the like, and detects the position of a sheet so as to detect an occurrence of jam, position of jam occurred and release from jam, and outputs the detected information to the control member 21.

The first carrying member 24*a* carries a sheet ejected from the image forming unit 1 to a ejection tray of the first collecting member 25*a* using a roller having an actuating portion consisting of a motor and the like.

The second carrying member 24*b* carries a sheet performed various sheet finishing to a ejection tray of the second carrying member 25*b* using a roller having an actuating portion consisting of a motor and the like.

The first carrying member 25*a* includes an ejection tray which ejects and collects a sheet where no sheet finishing process such as folding process and punching process has performed. The second collecting member 25*b* includes an ejection tray which collects a sheet where a sheet finishing process such as folding process and punching process has performed.

The alignment member 26 aligns a plurality of sheets in carrying direction and a width direction perpendicular to the carrying direction. The alignment member 26 is installed with a tilt so that a sheet carried above the alignment member 26 through a carrying path slips down to a stopper by the own weight thereof and stops. Thus, a plurality of sheets are aligned in carrying direction. The alignment member 26 also aligns the sheets in width direction of sheet face perpendicular to the carrying direction by a tatting mechanism which is not illustrated.

The punching member 27 punches a hole having predetermined shape at a predetermined position of a sheet ejected from an image forming unit 1. The center folding member

28*a* is composed of a sheet poking member, folding roller, carrying belt, pressing roller and the like, which are not illustrated. In the center folding member 38, a poking board of the poking member moves straight obliquely upward according to a center folding starting signal. An apical end of the poking board pushes up the center of the bundle of sheets, so that the nipping parts of the folding roller oscillate to be apart. After the apical part of the poking board passes through the nipping part, the poking board moves back and the folding roller pinches and presses the center part of the bundle of sheets to form a folded portion. Further, the folding member 28*b* folds a bundle of sheets aligned by the alignment member 26 at predetermined folding position.

At least one indicating member 29 is installed in order to inform the sheet finisher unit, and further installed at a vicinity of the sheet ejection trays provided to the first collecting member 25*a* and the second collecting member 25*b*, and they illuminate according to the control of the control member 30. Concretely, at least one indicating member 29*a* for informing the sheet finisher unit and a plurality of the indicating members 29*b* to 29*e* at a vicinity of a plurality of ejection trays are installed.

The indicating member 29 is composed of a light emitting part such as a LED (Light Emitting Diode), LCD, lamp (rotating lamp as an example) or the like. When the light emitting part is not limited to a single color but comprises three primary colors of light of R (red), G (green) and B (blue), illuminating color of the light emitting part can be changed in accordance with a control of the indicating control member 30. The present embodiment is explained by an example, where the indicating member 29*a* is composed of a rotating lamp, and the indicating member 29*b* to 29*d* are composed of LED.

The indicating member 29 can change the display mode thereof, and can perform continuous lighting and blinking as examples. According to the constitution, when the detecting member 23 detects a jam and output the detected information to the indicating control member 30, the indicating control member 30 cam informs the user of the jam by lighting the indicating member 29 in a different mode from one at sheet ejection according to a type of jam. For example, it is possible that, when the sheet ejection tray become full, the indicating member 29 blinks in yellow light to arouse the user taking off the sheets, and when a failure occurs, a blink of red light informs the user of a type and position of jam occurred.

Further, the indicating member 29 can further include LCD (Liquid Crystal Display) and the like so as to display various operation buttons, a status of the apparatus and an operating progress of each function, and after-mentioned ejection position indicating screen (see FIG. 17), according to the indicating signal input from the indicating control member 30.

The indicating control member 30 outputs an indicating signal for controlling the indicating member 29 to the indicating member 29. Concretely, the indicating control member 30 executes indicating processes 1 to 5 (see FIG. 9 to 13) for lighting the indicating member 29*a* provided to the sheet finisher unit and 29*b* to 29*e* provided at the ejection trays to which sheets given various sheet finishing is ejected. The individual processes will hereinafter be described in detail.

Next, an internal constitution of the sheet finisher unit 3 will be explained. In the sheet finisher unit 3, it is to be noted that the same reference numeral is rendered to the same potion as that of the sheet finisher unit 2 and detailed description thereof is omitted, since the sheet finisher unit 3 have almost same constitution as that of the sheet finisher unit 2. Therefore the constitution characteristic to the sheet finisher unit 3 will be explained hereinbelow.

The stack alignment member 36 is installed with a tilt so that the sheet carried above the alignment member 36 from a carrying path slips down to a stopper by the own weight thereof and stops. Thus, a plurality of sheets in the sheet alignment member 36 are aligned in carrying direction, so as to be in an arranged condition in a carrying direction. The sheets are also aligned in width direction of sheet face perpendicular to the carrying direction by a tatting mechanism which is not illustrated so as to be in an arranged condition in width direction.

Two sets of stitching member 37 are allocated in a direction perpendicular to the carrying direction, and are capable of moving in a direction perpendicular to the carrying direction by an actuating member which is not illustrated. The stitching member 37 staples two points of a sheet, located at either side of a centerline of width direction, same interval away from the centerline, after the sheets aligned by the stack alignment member are moved to a predetermined position.

The sheet cutting member 39 is composed of an upper cutting blade, lower cutting blade, movable board, press roller, actuating member and the like all of which are not illustrated. The sheet cutting member 39 cuts a side wall of a sheet bundle which has been bound by the stitching process and the saddle folding process in order to align a side wall of the sheet bundle.

The indicating members 40 are composed of an illuminating component such as a LED, LCD and lamp, as same as the above-described indicating member 29. There are two types of the indicating members 40, i.e. one for informing the sheet finisher unit and one for informing the ejection tray to which a sheet is to be ejected installed at a vicinity of a ejection tray provided to the first collecting member 35*a* and a ejection tray provided to the second collecting member 35*b*. Concretely, as shown in FIG. 1, at least one indicating member 40*a* for informing the sheet finisher unit 3, and the indicating member 40*b* to 40*c* at a vicinity of a plurality of the ejection trays are provided. It is to be noted here that the present invention is explained with an embodiment where the indicating member 40*a* is composed of a rotation signal and the indicating member 40*b* to 40*c* are composed of LED.

Next, an operation of the embodiment according to the present invention will be explained.

It is to be noted prior to the explanation of the operation that the programs for executing each process described in the following flowcharts are stored in a ROM in a form of program code readable by the control member 11 of the image forming unit 1, the control members 21 and 31 and the indicating control members 30 and 41 of the sheet finisher units 2 and 3, and the control member 11 to 31 and the indicating control member 30 and 41 execute the operation one after another according to the program codes.

Figure 5:
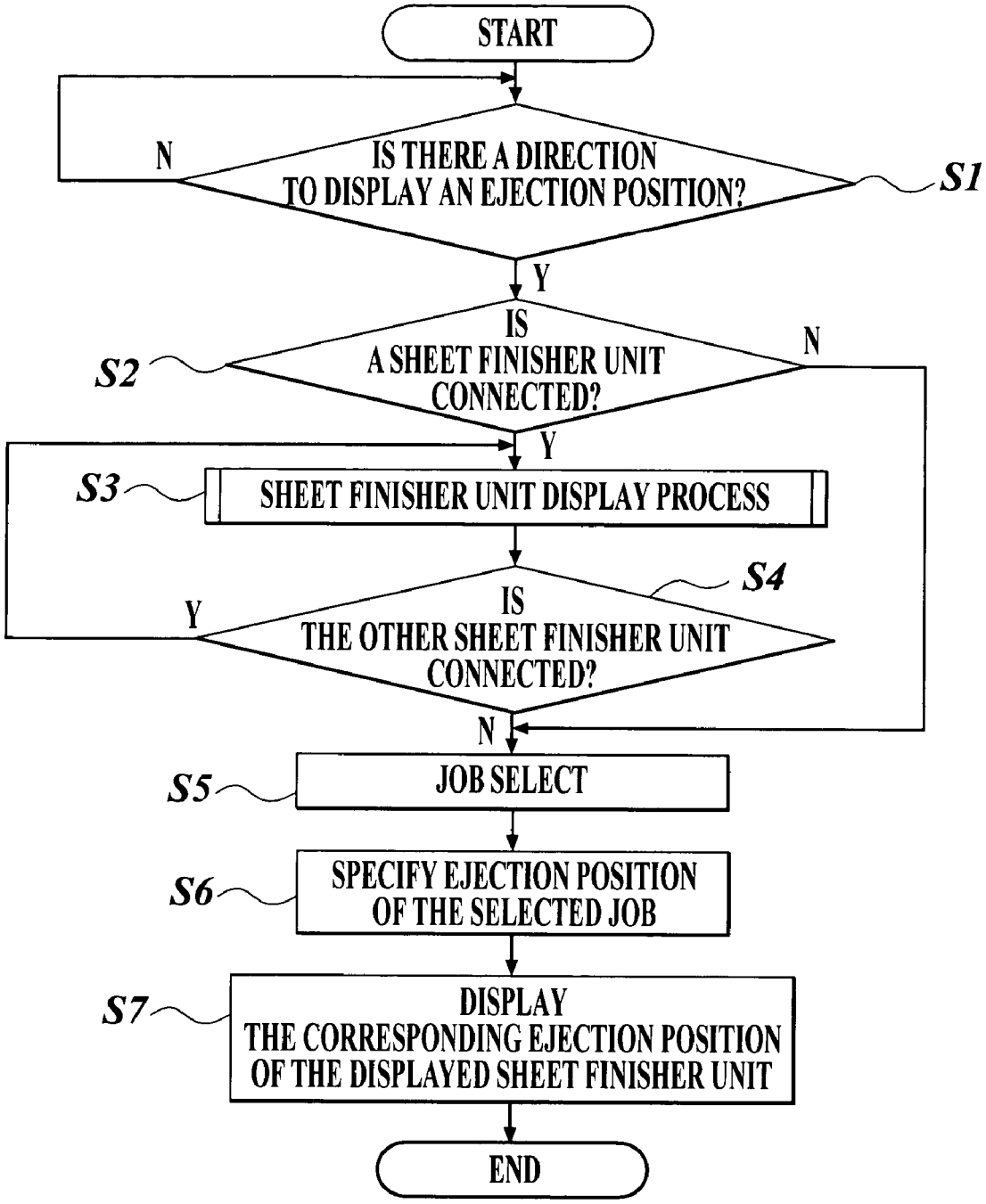
FIG. 5 is a flowchart showing an ejection position indicating process executed by a control member 11 of the image forming unit 1.

The ejection position indicating process 1 executed by the control member 11 of the image forming unit 1 will be explained with referring FIG. 5. As shown in FIG. 5, when a direction to indicating an ejection position is input via the input member 13*a* (step S1; YES), the control member 11 controls the serial communication member 12 so as to judge whether the sheet finisher units 2 and 3 are connected with the image forming unit 1 or not (step S2).

Figure 6:
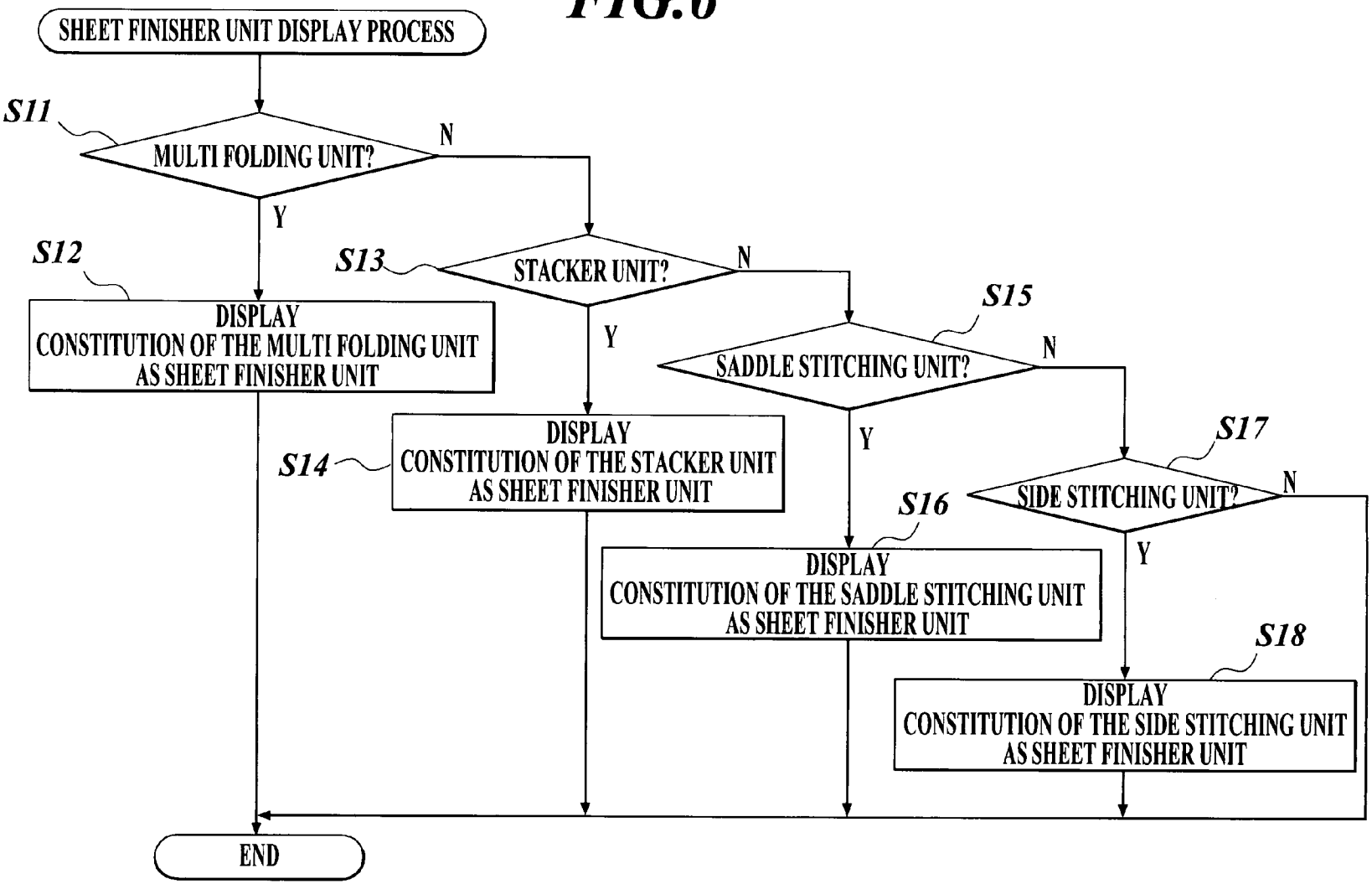
FIG. 6 is a flowchart showing a unit indicating process executed as a part of the ejection position indicating process.

When the sheet finisher units 2 and 3 are connected (step S2; YES), the control member 11 executes the sheet finishing unit indicating process described below (step S2). FIG. 6 is a flowchart showing a sheet finisher unit indicating process executed by the control member 11 of the image forming unit 1. As shown in FIG. 6, the control member 11 judges the type of unit provided to the connected sheet finisher unit. First, the control member 11 judges whether a multi folding unit is provided to the connected sheet finisher unit or not (step S11).

When a multi folding unit is provided to the sheet finisher unit 2 (step S11; YES), the control member 11 displays a constitution of the multi folding unit as the sheet finisher unit on the indicating member 13*b* (step S12). When a multi folding unit is not provided to the sheet finisher unit (step S11; NO), the control member 11 judges whether the provided unit is a stacker unit or not (step S13).

When a stacker unit is provided (step S13; YES), the control member 11 displays a constitution of the stacker unit as the sheet finisher unit on the indicating member 13*b* (step S14). When the provided unit is not a stacker unit (step S13; NO), the control member 11 judges whether the provided unit is a saddle stitching unit or not (step S15).

When a saddle stitching unit is provided (step S15; YES), the control member 11 displays a constitution of the saddle stitching unit as the sheet finisher unit on the indicating member 13*b* (step S16). When the provided unit is not a saddle stitching unit (step S15; NO), the control member 11 judges whether the provided unit is a side stitching unit or not (step S17).

When a side stitching unit is provided (step S17; YES), the control unit 11 displays a constitution of the side stitching unit as the sheet finisher unit on the indicating member 13*b* (step S18). When a side stitching unit is not provided (step S17; NO), the control member 11 terminates the sheet finisher unit indicating process, and makes a shift to an ejection position indicating process.

Back to FIG. 5, the control member 11 judges whether other sheet finisher unit is connected to the image forming unit 1 or not (step S4). When other sheet finisher unit is connected (step S4; YES), the above-described unit indicating processes are executed repeatedly in order to display the unit provided to the other sheet finisher (step S3). When other sheet finisher unit is not connected (step S4; NO), that is, when all the sheet finishers connected to the image forming unit 1 are displayed, the control member 11 makes the user select a job (step S5).

Figure 14:
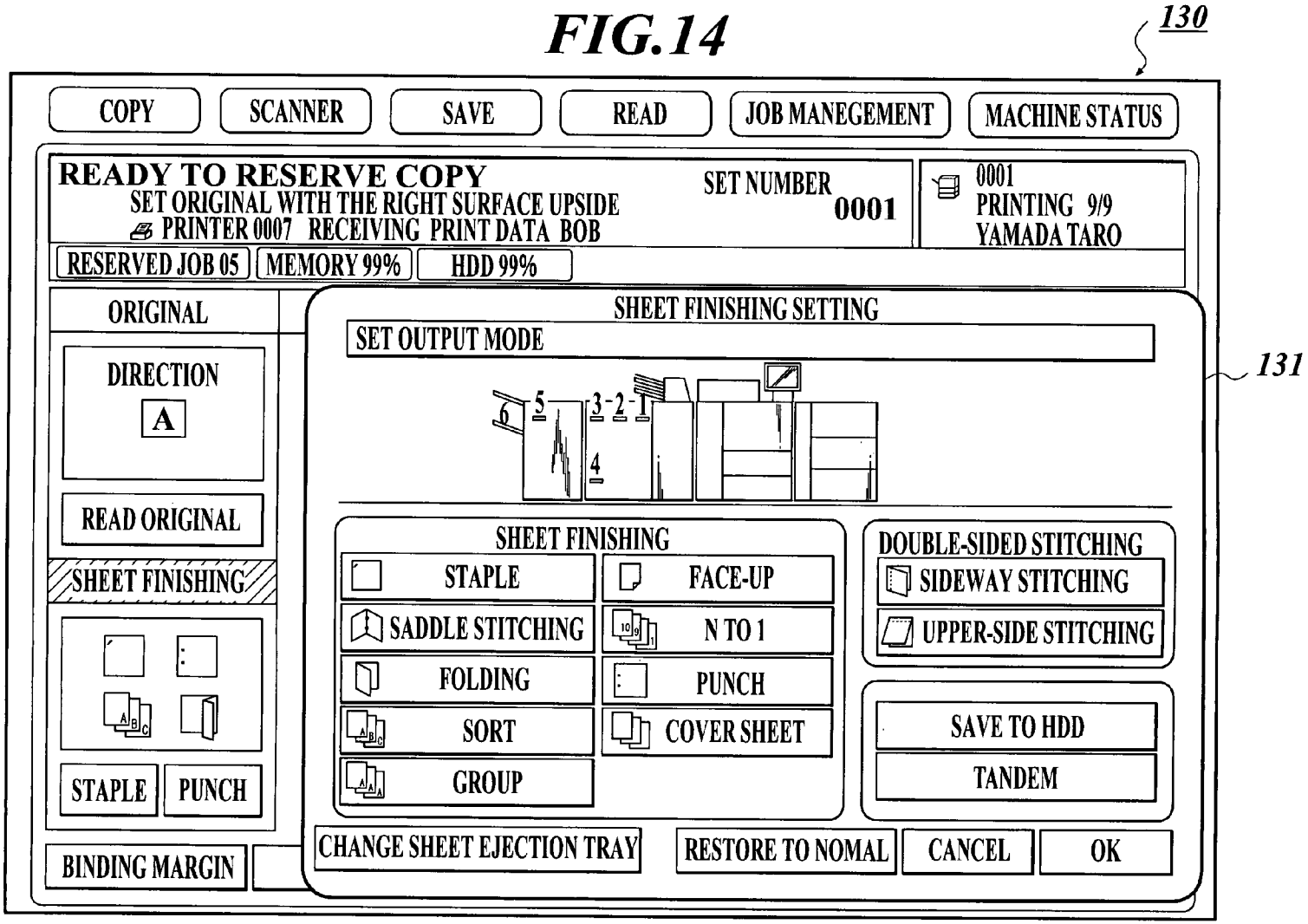
FIG. 14 shows one of examples a sheet finishing mode setting screen 131 displayed on an indicating member 13*b* of the image forming unit 1.
Figure 15:
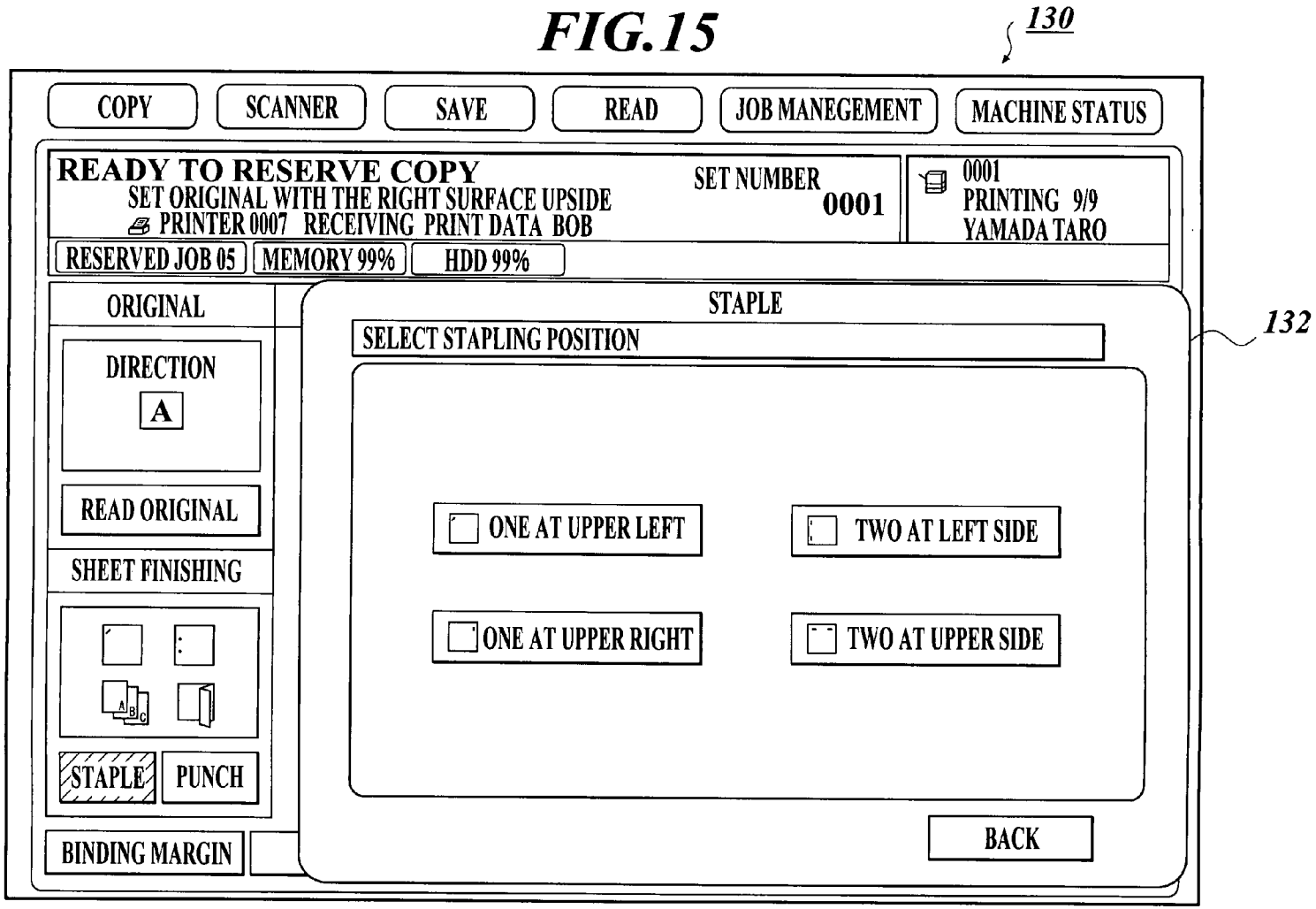
FIG. 15 shows one of examples of a details setting screen 132 displayed on the indicating member 13*b* of the image forming unit 1.
Figure 16:
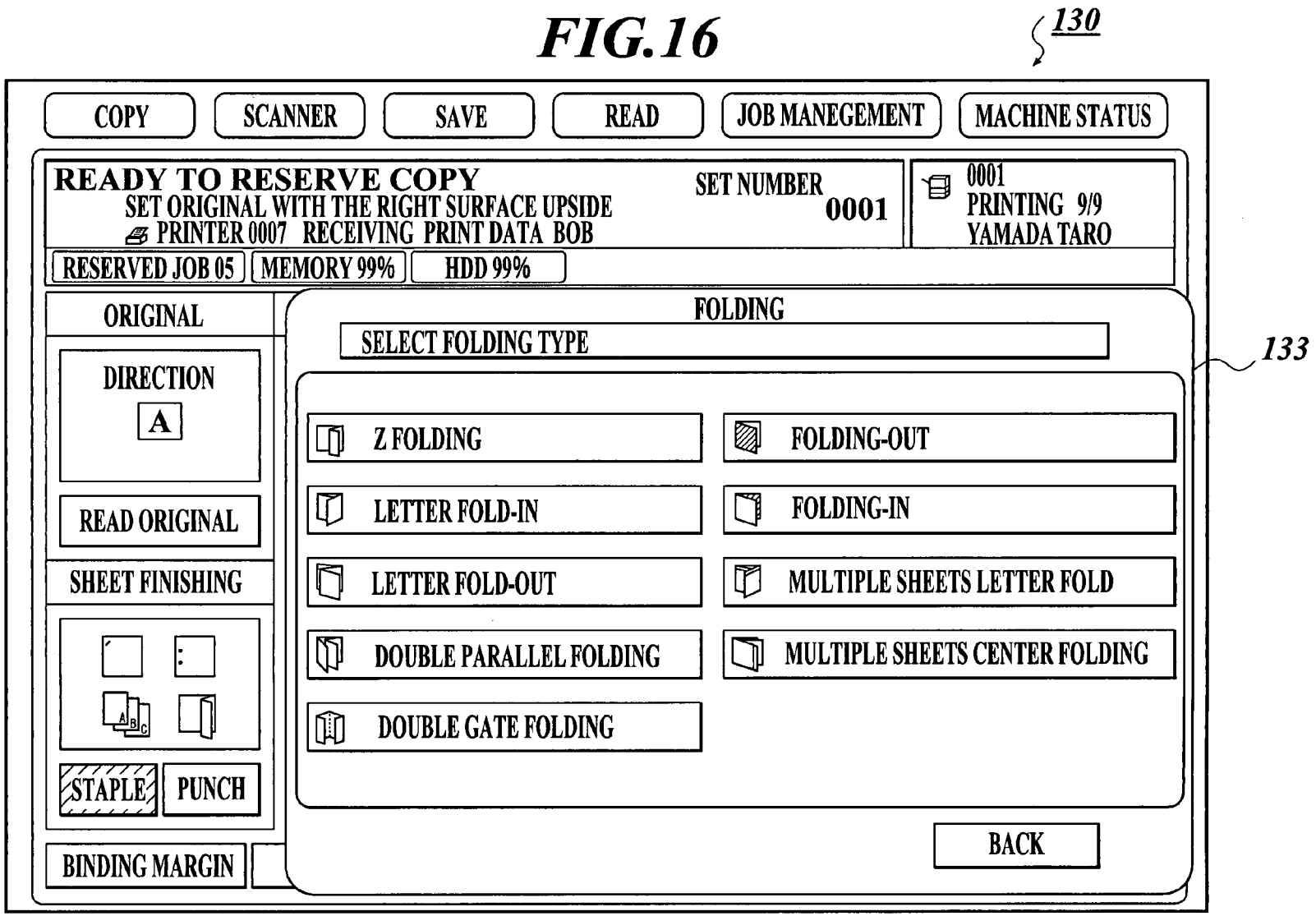
FIG. 16 shows one of examples of a details setting screen 133 displayed on the indicating member 13*b* of the image forming unit 1.

With reference to FIGS. 14 to 16, a method for selecting a job is explained. FIG. 14 shows one of examples of sheet finishing mode setting screen. As shown in FIG. 14, a sheet finishing mode setting screen 131 pops up over a base screen 130, when a sheet finishing setting button in the base screen 130 is pushed. The sheet finishing mode setting screen 131 schematically displays unit constitution view of the image forming unit 1 and sheet finisher units 2 and 3 and also has a sheet finishing mode selecting button for selecting a sheet finishing mode.

The sheet finishing mode selecting buttons correspond to various modes such as a stapling mode, saddle stitching mode, folding mode, sorting mode, grouping mode, facing up mode, N to 1 mode, punching mode, cover sheet mode and the like. When the sheet finishing mode selecting button corresponding to each mode is pushed, a details setting screen corresponding to each sheet finishing mode pops up over the base screen.

FIG. 15 shows an example of the details setting screen displayed by popping up over the base screen when the sheet finishing mode selecting button correspond to the stapling mode is pushed. As shown in FIG. 15, the details setting screen 132 has position selecting buttons for selecting a position to be stapled. The position selecting button corresponding to each position to be selected is pushed, the selected position is set as a position to be stapled. Further, FIG. 16 shows an example of a details setting screen displayed by popping up over the base screen 130 when the sheet finishing mode selecting button correspond to the folding mode is pushed. As shown in FIG. 16, a details setting screen 133 has folding selecting buttons for selecting a type of folding. In the above setting screens, the sheet finishing mode and job are selected by inputting various directions.

Back to FIG. 5, the control member 11 identifies an ejection position corresponding to the selected job (step S6). Concretely, when the sheet finishing judging member 20 judges the sheet finishing unit based on the elected job, the control member 11 specifies a sheet ejection position corresponding to the sheet finisher unit according the judgment. Successively, the control member 11 lights by light the ejection position corresponding to the unit displayed on the indicating member 13*b* according to the specified sheet ejection position (step S17), and the control member 11 finishes the sheet finisher unit indicating process.

Figure 17:
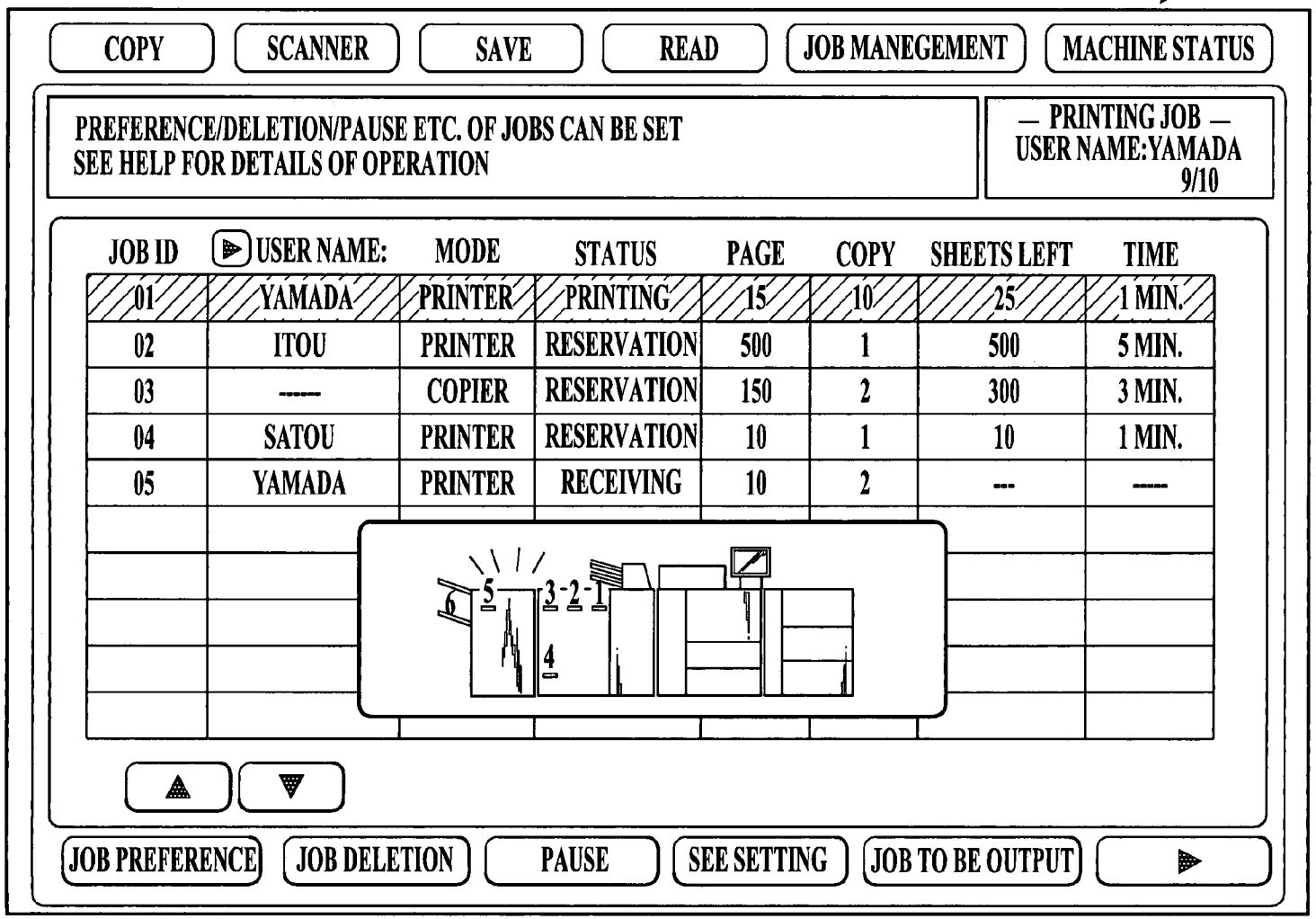
FIG. 17 shows one of examples of an ejection position indicating screen 134 displayed in the indicating member 13*b* of the image forming unit 1.

FIG. 17 shows one of examples of an ejection position display screen displayed on the indicating member 13*b* of the image forming unit 1. As shown in FIG. 17, an ejection position display screen 134 displays a list of jobs registered in the image forming unit 1 as well as the schematic unit constitution views of the image forming unit 1 and the sheet finisher units 2 and 3. In the ejection position display screen 134, when an optional job is selected from the list of jobs through the input member 13*a*, the indicating member 13*b* illuminates and indicate light the portion corresponding to an ejection tray to which a sheet is to be ejected according to the selected job (for example, (5) in the Figure). Thus the user can adequately figure out the ejection tray to which a sheet is to be ejected in the desired job, so that the user can manage the sheets to be ejected in a concentrated manner.

The process for indicating the ejection tray to which a sheet is to be ejected on the ejection position display screen 134 can be performed after a reservation of a job or an output of a job, so that the ejection position can be indicated in appropriate timing according to user's utilization. Thus it becomes possible that the user preliminary figures out a sheet to be ejected and collects the sheet systematically.

Figure 7:
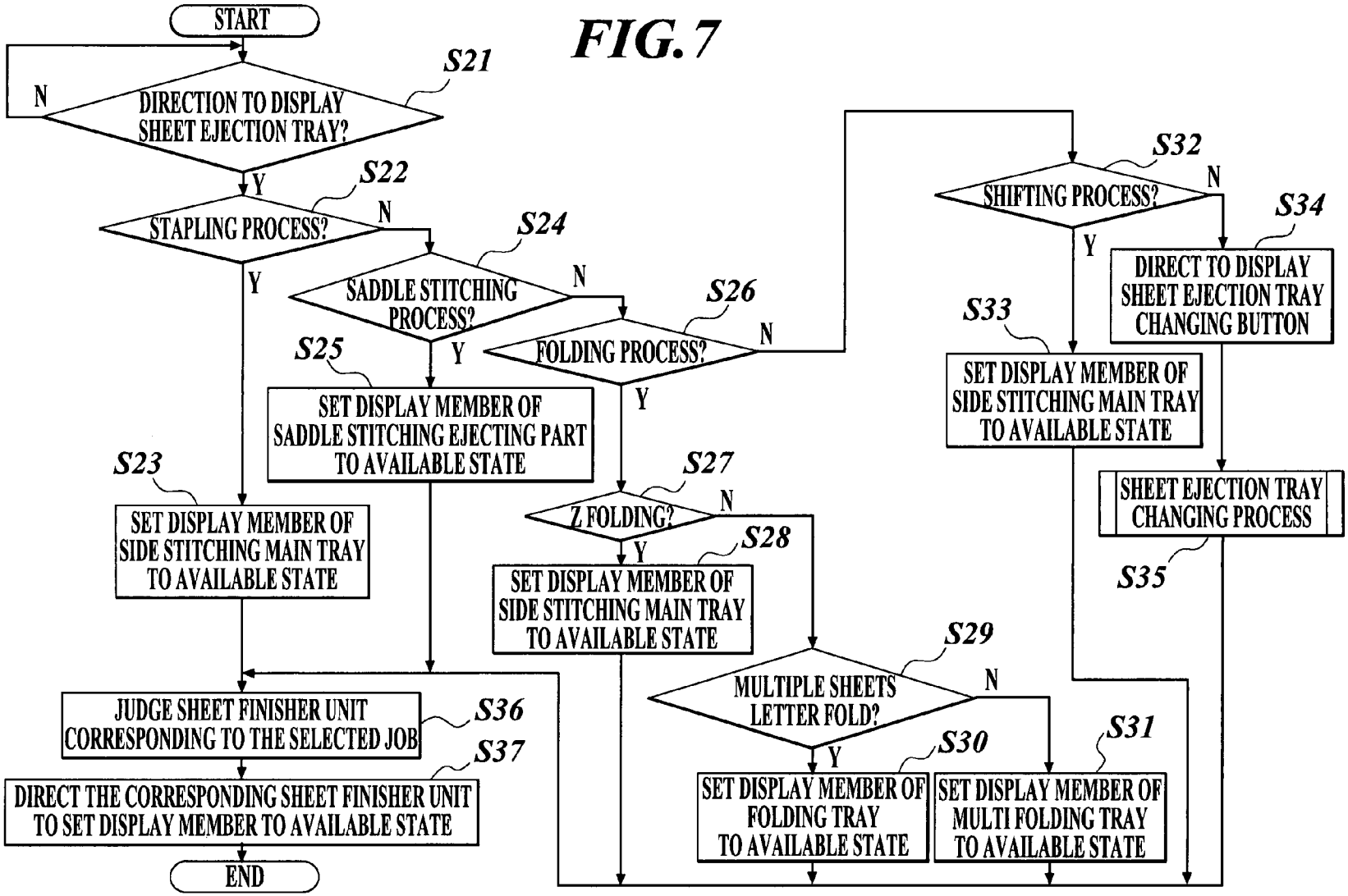
FIG. 7 is a flowchart showing a sheet ejection tray selecting process executed by the control member 11 of the image forming unit 1.

A sheet ejection tray selecting process for lighting the indicating member 29*a* and 40*a* (hereinafter collectively called a "indicating member A") provided to the sheet finisher units 2 and 3 and the indicating member 29*b* to 29*e*, 40*b* and 40*c* (hereinafter collectively called a "indicating member B") will be explained. FIG. 7 is a flow chart showing the sheet ejection tray selecting process executed by the control member 11. As shown in FIG. 7, the control member 11 judges whether the direction to light the indicating members A and B of the sheet ejection tray is input or not (step S21). It is to be noted here that the direction to light the indicating members A and B is directions such as pushing a start button or completion of registration of a job, start up of a job, completion of a job and the like.

When a direction to indicate the indicating members A and B provided to the sheet ejection tray is input (step S1; YES), the sheet finisher judging member 20 judges whether the sheet finishing mode is set to the stapling mode or not (step S22).

When a mode to perform the stapling process is input (step 22; YES), the control member 11 sets the indicating member B provided to a side stitching main tray to an available state. When a mode to perform a stapling process is not input (step S22; NO), the sheet finishing judging member 20 judges whether the mode to perform a saddle stitching process is set or not (step S24).

A mode to perform a saddle stitching process is set (step S24; YES), the control member 11 sets the indicating member B provided at saddle stitching ejection position to an available state (step S25). When the mode to perform a saddle stitching process is not input (step S22; NO), the sheet finishing judging member 20 judges whether the direction to perform a folding process is input or not (step S24).

When a mode to perform a folding process is set (step S26; YES), the sheet finishing judging member 20 judges whether the set mode is a Z folding process among the various folding processes or not (step S27). When the mode to perform a Z folding process is set (step 27; YES), the control member 11 sets the indicating member B 29 of a side stitching main tray to an available state (step S28).

When a mode to perform a multiple sheets letter folding process is input (step S29; YES), the control member 11 sets the indicating member B provided to a folding tray to an available state (step S30). Besides, when a mode to perform a folding process except Z folding process and multi sheets letter folding process is input (step S29; NO), the control member 11 sets the indicating member B of a multi-folding tray to an available state (step S31).

Back to the step S26, when a mode to perform a folding process is not set (step S26; NO), the sheet finishing judging member 20 judges whether a mode to perform a shifting process is set or not (step S32). It is to be noted here that the shifting process is one to shift an ejection tray, which is movable in width direction or length direction, in a definite direction in each job while ejecting sheets.

When a mode to perform a shifting process is set (step S32; YES), the control member 11 sets the indicating member B provided to a side stitching main tray to an available state (step S22). When a mode to perform a shifting process is not input (step S32; NO) and a sheet ejection tray changing button is pushed (step S34), the control member 11 executes a sheet ejection tray changing process (see FIG. 8) (Step S35).

Figure 8:
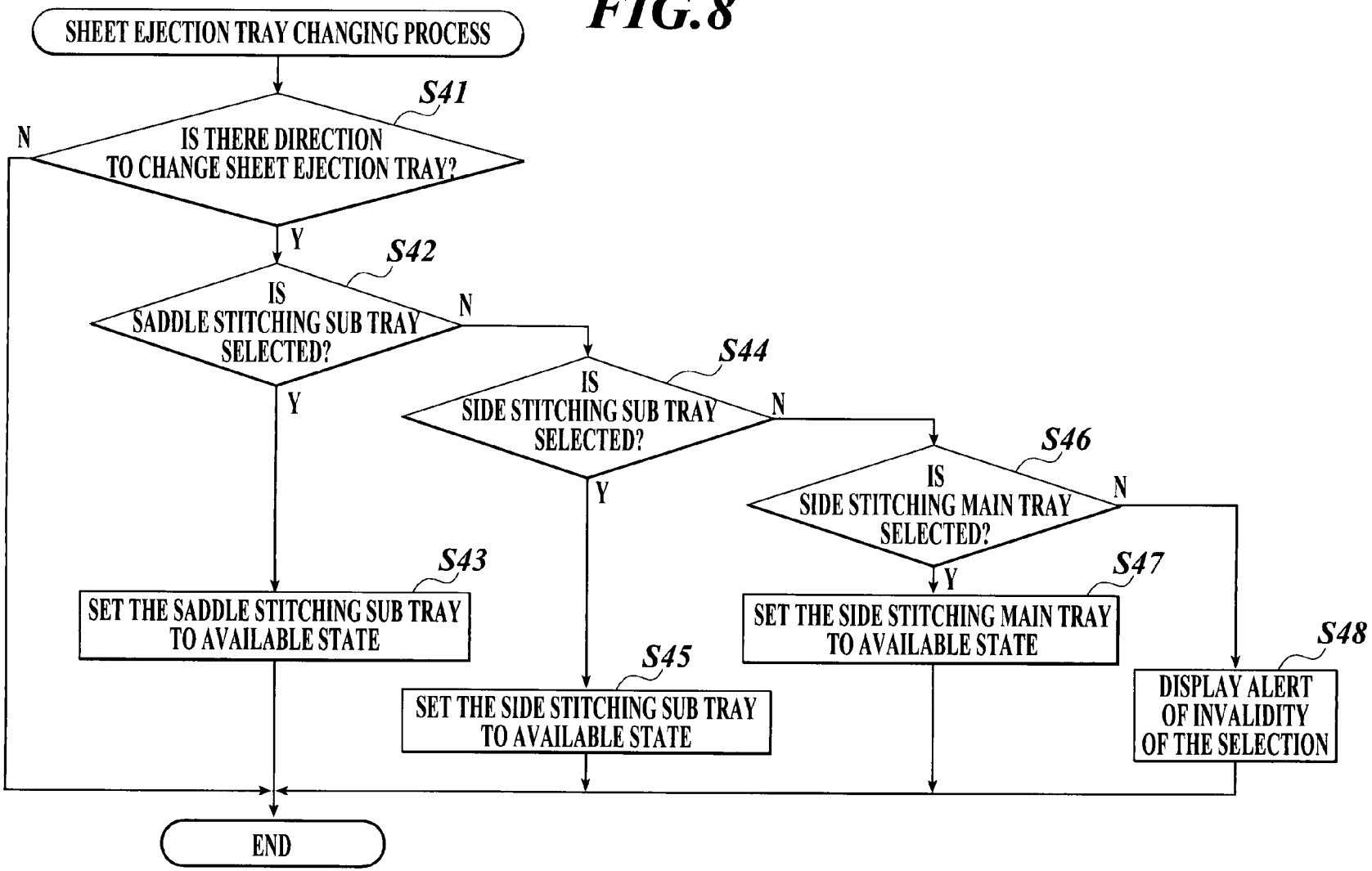
FIG. 8 is a flowchart showing a sheet ejection tray changing process executed as a part of the sheet ejection tray selecting process.

FIG. 8 is a flow chart showing the sheet ejection tray changing process executed by the control member 11. As shown in FIG. 8, the control member 11 judges whether the direction to change a sheet ejection tray is input or not (step S41). When the direction to change a sheet ejection tray is input (step S41; YES), the control member 11 judges the selected tray according to the input direction. When the selected tray is a saddle stitching sub tray (step S42; YES), the control member 11 sets the indicating member B of the saddle stitching sub tray to an available state (step S43).

When the selected tray is the saddle stitching sub tray (step S44; YES), the control member 11 sets the indicating member B of the saddle stitching sub tray to an available state (step S45). The selected tray is a saddle stitching main tray (step S46; YES), the control member 11 sets the indicating member B of the saddle stitching main tray to an available state (step S47). Further, when any one of the saddle stitching sub tray, side stitching sub tray and side stitching main tray is not selected (step S46; NO), the control member 11 indicates a caution showing invalidation of a selection to the indicating member 13*b*, and finish the sheet ejection tray changing process.

Back to FIG. 7, the sheet finishing judging member 20 judges a sheet finisher unit corresponding to the selected job (step S36), the control member 11 outputs a direction to set the indicating member A and the indicating member B corresponding to the selected position to the corresponding sheet finisher unit (step S37), and finishes the sheet ejection tray selecting process.

Next, with reference to FIGS. 9 to 13, the indicating processes 1 to 5 executed by the indicating control members 30 and 41 of the sheet finisher units 2 and 3 are explained. It is accounted the control members 21 and 31 of the sheet finisher units 2 and 3 have received a direction to set the indicating members A and B to an available state, since the above sheet ejection tray selecting process is executed in the image forming unit 1 previously to execution of the indicating processes 1 to 5. Hereinafter, the operation will be explained, where the indicating control member 30 of the sheet finisher unit 2 is chosen as a representative.

Figure 9:
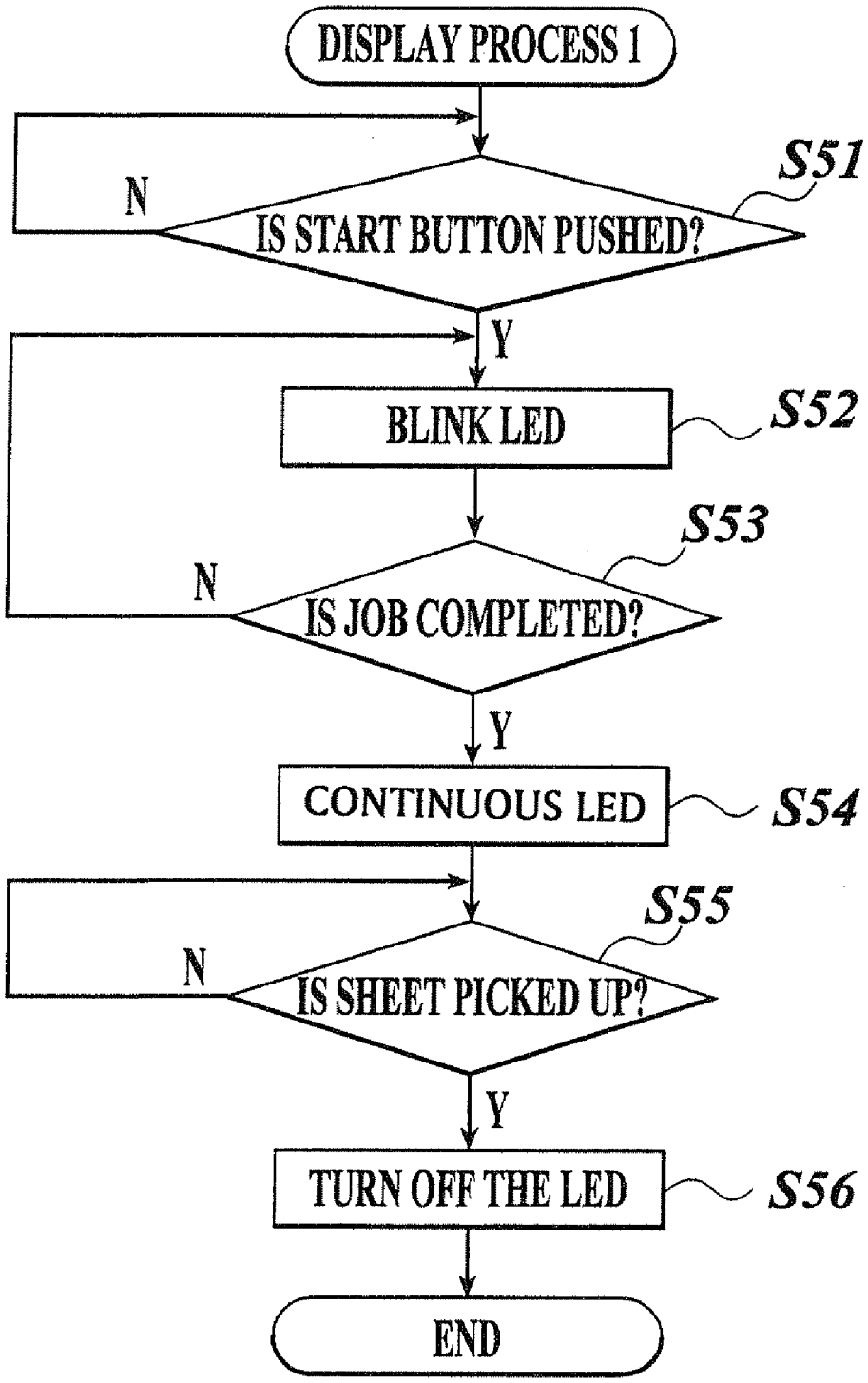
FIG. 9 is a flowchart showing an indicating process 1 executed by indicating control members 30 and 41 of the sheet finisher units 2 and 3.

FIG. 9 is a flowchart showing an indicating process 1 for lighting the indicating members A and B when the starting button is pushed. As shown in FIG. 9, when the push signal of the starting button is input from the image forming unit 1 via a serial communication member 22*a* (step S51; YES), the indicating control member 30 blinks LED of the indicating members A and B which are in an available state (step S52). Subsequently, the indicating member 30 judges whether the job is completed or not (step S53). When the job is completed (step S53; YES), the indicating member 30 changes the display mode of the indicating members A and B from blinking to continuous lighting (step S54). Successively, the indicating member 30 judges whether a sheet is picked up from the corresponding sheet ejection tray or not (step S 55). When the sheet is picked up (step S55; YES), the indicating member 30 turns off the LED and finishes the indicating process 1.

The above indicating process 1 is effective when the sheet finisher unit is such as a stacker unit. As described above, the stacker unit has a door in front thereof. A process is interrupted by a safety function when the door is opened or closed at work (in the course of a stacking process). In lighting the indicating members A and B provided to the stacker unit, it can inform whether a sheet can be picked up or not in accordance with a condition of a process by changing the display mode of the indicating members A and B.

Figure 10:
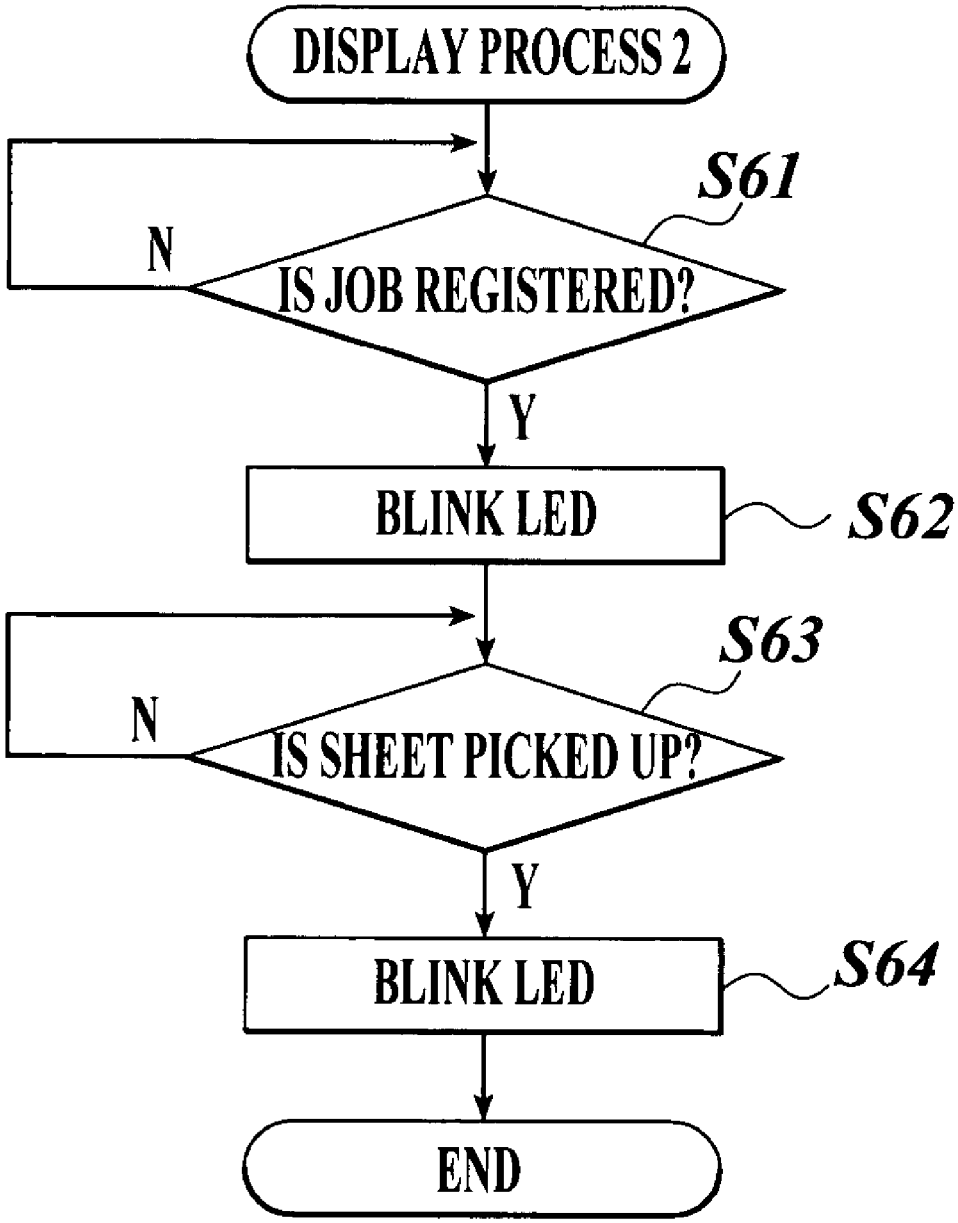
FIG. 10 is a flowchart showing an indicating process 2 executed by indicating control members 30 and 41 of the sheet finisher units 2 and 3.

FIG. 10 is a flowchart showing an indicating process 2 for lighting the indicating members A and B when a job is registered. As shown in FIG. 10, when a completion of a job registration is directed via the serial communication member 22*a* (step S61; YES), the indicating control member 30 indicates by light the indicating members A and B which are in an available state (step S62). Subsequently, the indicating control member 30 judges whether a sheet is picked up from the corresponding tray or not (step S63). When a sheet is picked up (step S63; YES), the indicating member 30 turns off the LED (step S64) and finishes the indicating process 2.

Figure 11:
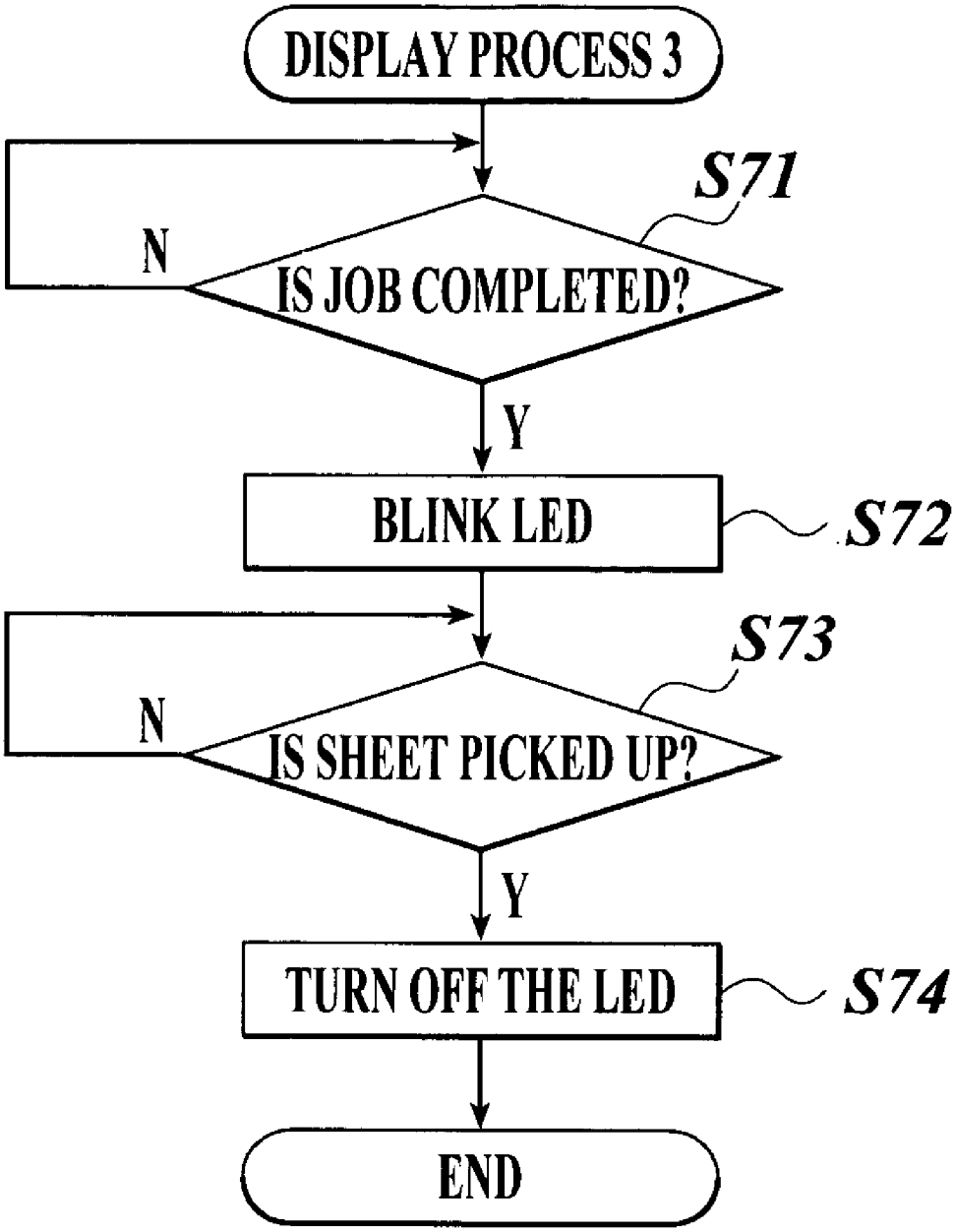
FIG. 11 is a flowchart showing an indicating process 3 executed by indicating control members 30 and 41 of the sheet finisher units 2 and 3.

FIG. 11 is a flowchart showing an indicating process 3 for lighting the indicating members A and B when a job is completed. As shown in FIG. 11, the indicating member 30 judges whether the job is completed or not (step S71). When the job is completed (step S71; YES), the indicating control member 30 lights LED of the indicating members A and B which are in an available state (step S72). Subsequently, the indicating control member 30 judges whether a sheet is picked up from the corresponding tray or not (step S73). When a sheet is picked up (step S73; YES), the indicating control member 30 turns off the LED (step S74) and finishes the indicating process 3.

Figure 12:
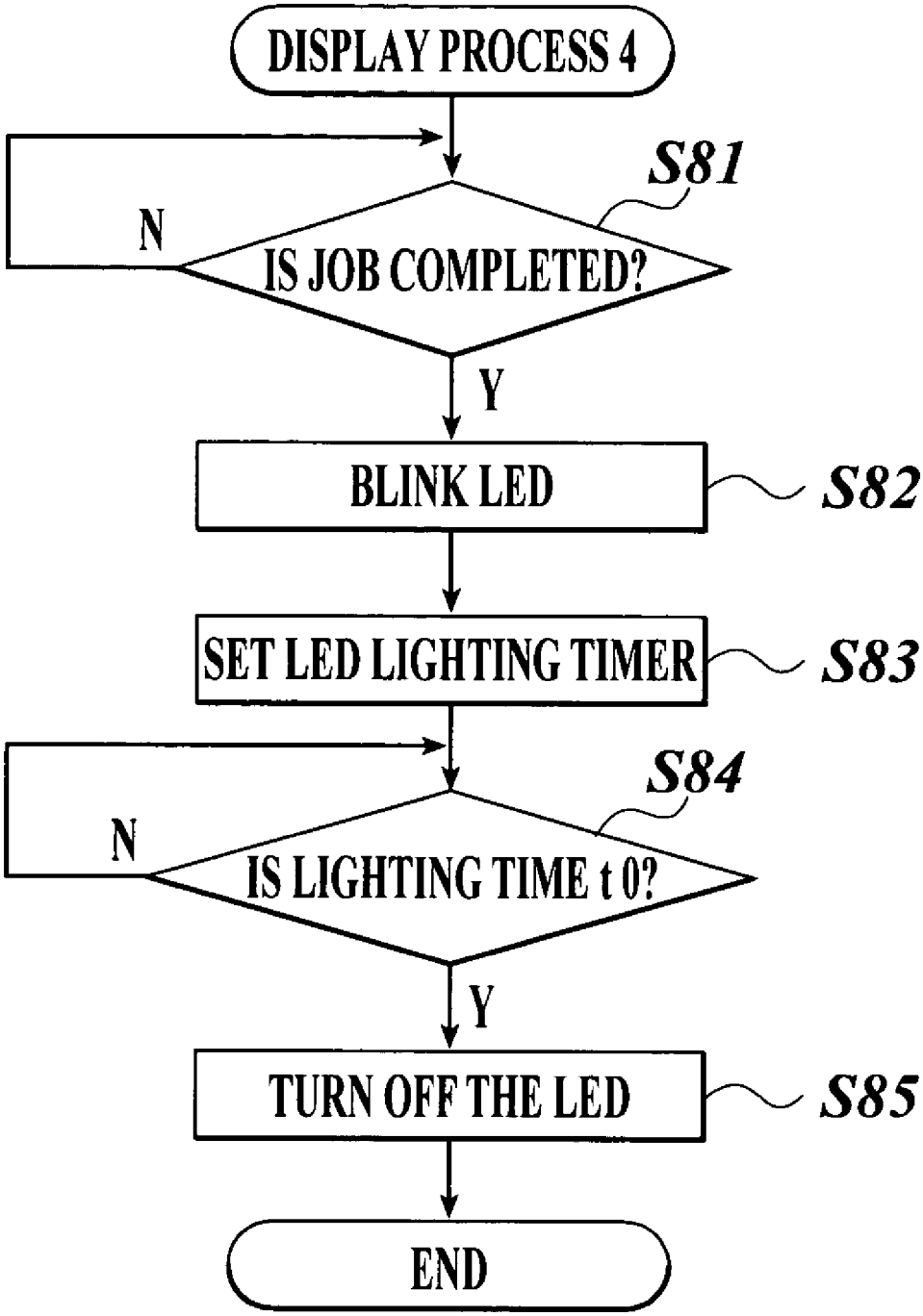
FIG. 12 is a flowchart showing an indicating process 4 executed by indicating control members 30 and 41 of the sheet finisher units 2 and 3.

FIG. 12 is a flowchart showing an indicating process 4 for lighting the indicating members A and B with timer-control. As shown in FIG. 12, the indicating control member 30 judges whether a job is completed or not (step S81). When the job is completed (step S81; YES), the indicating control member 30 lights LED of the indicating members A and B (step S82). Subsequently, the indicating control member 30 sets a timer for lighting the LED for a predetermined time (step S33), and judges whether the lighting time t is 0 or not (step S84). When the lighting time t becomes 0 (step S84; YES), the indicating control member 30 turns off the LED (step S85) and finishes the indicating process 4.

Figure 13:
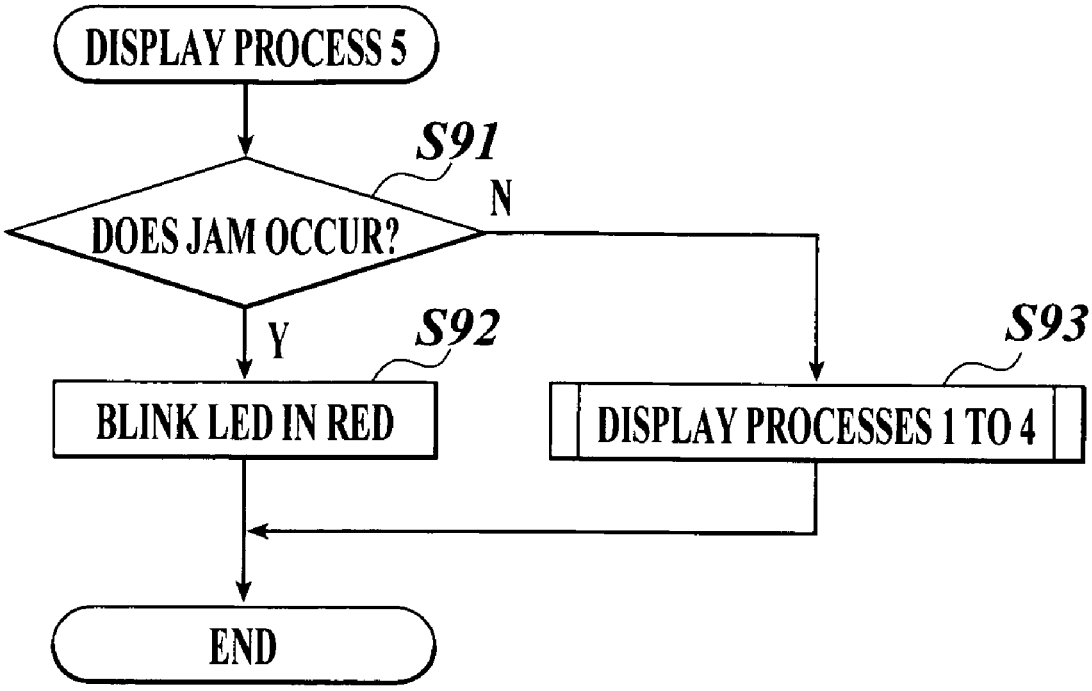
FIG. 13 is a flowchart showing an indicating process 5 executed by indicating control members 30 and 41 of the sheet finisher units 2 and 3.

FIG. 13 is a flowchart showing an indicating process 5 for lighting the indicating members A and B in a different display mode from usual one when a jam occurs. As shown in FIG. 13, the indicating control member 30 judges whether a jam occurs or not, based on a jam detecting signal input from a detecting member 23 (step S91). When a jam occurs (step S91; YES), the control member 30 lights LED of the indicating members A and B which are set in an available mode in a different display mode from usual one, e.g. red blinking (step S92), and finishes the indicating process 5. When a jam does not occur (step S 91; NO), the control member 30 shifts to one of the above-described indicating processes 1 to 4 and executes a usual indicating process.

As described above, the image forming apparatus 100 of the present embodiment comprises the sheet finisher units 2 and 3 having a plurality of the sheet ejection trays, the indicating member 29*a* and 40*a* (indicating member A) corresponding to the sheet finisher units and a plurality of the indicating member 29*b* to 29*e*, 40*b* and 40*c* (indicating member B) respectively provided at a vicinity of a plurality of the sheet ejection trays. When a sheet is ejected, the image forming apparatus 100 lights the indicating members 29*a* and 40*a* corresponding to the sheet finisher units 2 and 3 to which a sheet is to be ejected and the indicating member 29*b* to 29*e*, 40*b* and 40*c* provided at a vicinity the sheet ejection trays specified by the set sheet finishing mode.

When a sheet finishing process is performed to a sheet output from the image forming unit 1 and the sheet is ejected to a plurality of ejection trays provided to the sheet finisher units 2 and 3, it is possible for a user to know the sheet finisher unit and the ejection tray where the sheet is to be ejected easily and certainly. Thus since the ejected sheet is not lost, the user can collect the output sheets effectively, even if a large number of sheets are output.

The indicating control members 30 and 41 of the sheet finisher units 2 and 3 execute the indicating processes 1 to 3 properly, so that they can light the indicating members 29*a* to 29*e* and 40*a* to 40*c* in various timings. That is, any one of the indicating processes 1 to 3 is executed according to a setting of a user, so that it becomes possible to light the indicating members 29 and 40 in an optional timing such as at job starting, job registration, job completing, and the like. Further, execution of the indicating process 4 makes it possible to light the indicating members 29 and 40 with timer-control. For example, when an ejected sheet is not picked up and left for a long time, it is prevented the indicating members 29*a* to 29*e* and 40*a* to 40*c* keep lighting.

When a jam occurs, execution of the indicating process 5 makes it possible to inform the occurrence of a jam by lighting the indicating members 29*a* to 29*d* and 40*a* to 40*c* in a different display mode from usual one, such as red blinking. Thus, a user can recognize the occurrence of a jam rapidly and figure out the position of jam occurred exactly so as to relief the apparatus from a trouble immediately.

When a stacker is provided to the sheet finisher, the indicating member provided at a vicinity of an ejection tray illuminates after a completion of a sheet ejection so as to inform certainly that the sheet ejection is completed and the sheet can be picked up. Thus it becomes possible to prevent that the open and shut of the door of a stacker unit makes the process break off.

Furthermore, a list of registered jobs and a unit constitution view of the sheet finisher units 2 and 3 connected to the image forming unit 1 are displayed on the indicating member 13*b* provided to the image forming unit 1. When a certain job is selected from the listed jobs via the input member 13*a*, the ejection position corresponding to the selected job is indicated on the unit constitution view of the sheet finisher units 2 and 3.

Thus, a user can confirm an ejection position of the sheet only by browsing the indicating member 13*b* provided to the image forming unit 1. That is, a user can manage an ejection position of the sheet in a concentrated manner, which leads an improvement of operating effectiveness. Further when the user selects a certain job displayed on the indicating member 13*b*, an ejection position corresponding to the selected job is indicated. Thus it is convenient because the information relating to the desired job is easily obtained.

It is to be noted that the above description regarding to the embodiment of the present invention is only one of the appropriate examples of the image forming system 100, and the present invention is not limited thereto.

For example, the number of sheet finishers connected to the image forming unit 1 and function, constitution and mode of the unit provided to a sheet finisher unit are not limited to the aforementioned example.

In the present embodiment, the explanation is based on a constitution where an ejection position display screen 131 indicating a unit constitution view of the sheet finisher units 2 and 3 is displayed on the indicating member 13 provided to the image forming unit 1. However, other constitutions are possible, where an indicating member having LCD and the like are provided to a sheet finisher, and a control member of the sheet finisher executes the aforementioned ejection position indicating process 1 so as to display the ejection position indicating screen to the indicating member such as LCD.

In the embodiment of the present invention, the explanation is based on an example where the recording material ejected to an ejection tray is a sheet. However, the recording material is not limited to a sheet but includes an OHP sheet and like. Further, the above-described display modes of the indicating members 29*a* to 29*e* and 40*a* to 40*c* are only one of examples, and the present invention can be achieved using various display modes.

It is needless to say that detailed constitutions of each structure member in the image forming system 100 according to the present embodiment is variable within a scope of the present invention.

According to the present invention, an image forming unit having a plurality of sheet finisher units lights an indicating member provided to the sheet finisher units where a recoding material given a sheet finishing is to be ejected. Thus, it is possible to recognize a sheet finisher unit accurately, where the recoding material is to be ejected.

It is possible to light an indicating member provided at a vicinity of an ejection tray where a recording material is to be ejected, when a recording material is to be ejected from a sheet finisher unit having a plurality of sheet ejection trays. Thus, a user can accurately recognize a sheet ejection tray where a sheet is to be ejected, so that it becomes possible to pick up the ejected recording material rapidly.

Further, it is possible to provide an image forming apparatus having high versatility, since it can apply to a sheet finisher unit having various sheet finishing modes.

When a jam occurs in a course of ejecting a recording material, it is possible to light an indicating member provided at a vicinity of a sheet ejection tray where a jam has occurred. Thus, a user can recognize an occurrence of jam rapidly and find out the location of the jam, so as to eliminate the trouble immediately.

A user can realize a completion of sheet finishing as well as a sheet finisher unit and sheet ejection tray where a recording material is to be ejected.

A user can realize a progress of a sheet finishing process accurately as well as a sheet finisher unit and sheet ejection tray where a recording material is to be ejected.

Prior to a start of a sheet finishing, a user can realize a sheet finisher unit or sheet ejection tray where a recording material is to be ejected, so that the user can pick up the recording material effectively.

The entire disclosure of Japanese Patent Applications Nos. 2003-199689 and 2004-133889, filed on Jul. 22, 2003 and Apr. 28, 2004 respectively, including specification, claims, drawings and summary are incorporated herein by reference in its entirety.

What is claimed is:

1. An image forming apparatus comprising:

an image forming unit to form an image on a recording material;

a plurality of sheet finisher units, each of which is operable to perform a respective different sheet finishing to the recording material on which the image has been formed;

a plurality of indicating members, at least one of the indicating members being provided to each of the sheet finisher units;

an input member to accept an input of a sheet finishing mode corresponding to the sheet finishing performed by at least one of the sheet finisher units;

a sheet finishing judging member to identify the sheet finisher unit performing the sheet finishing corresponding to the input sheet finishing mode; and an indicating control member to light, based on a result of the identification by the sheet finishing judging member, the indicating member provided to the identified sheet finisher unit in a first display mode, at or before a time that the sheet finishing begins.

2. The apparatus of claim 1, wherein the sheet finishing mode comprises at least one of a folding mode, a stitching mode and a stacker mode.

3. The apparatus of claim 2, wherein the folding mode comprises at least one of a multiple sheets letter folding mode and a Z folding mode.

4. The apparatus of claim 2, wherein the stitching mode comprises at least one of a saddle stitching mode and a side stitching mode.

5. The apparatus of claim 1, wherein each of the sheet finisher units comprises a detecting member to detect an occurrence of a jam, and the indicating control member lights at least one said indicating member provided to the sheet finisher unit in which the jam has occurred in a second display mode when the detecting member detects the occurrence of a jam.

6. The apparatus of claim 1, wherein the indicating control member also lights the indicating member in the first display mode after the sheet finisher unit completes the sheet finishing.

7. The apparatus of claim 1, wherein the indicating control member also lights the indicating member in the first display mode while the sheet finisher unit is performing the sheet finishing.

8. The apparatus of claim 1, wherein the indicating control member lights the indicating member in the first display mode after the sheet finisher unit to perform the sheet finishing is identified.

9. The apparatus of claim 1, wherein the indicating control member starts said lighting at a start of a sheet finishing job.

10. The apparatus of claim 1, wherein the indicating control member starts said lighting at a registration of a sheet finishing job.

11. An image forming apparatus comprising:

an image forming unit to form an image on a recording material;

a plurality of sheet finisher units, each of which is operable to perform a respective different sheet finishing to the recording material on which the image has been formed;

a plurality of sheet ejection trays provided to each of the sheet finisher units, to which a recording material on which the sheet finishing is performed is ejected;

a plurality of first indicating members, at least one of the first indicating members being provided to each of the sheet finisher units;

a plurality of second indicating members provided respectively in a vicinity of at least a plurality of the sheet ejection trays, an input member to accept an input of a sheet finishing mode corresponding to the sheet finishing performed by at least one of the sheet finisher units;

a sheet finishing judging member to identify the sheet finisher unit and the sheet ejection tray which are used in the input sheet finishing mode; and an indicating control member to light, based on a result of the identification by the sheet finishing judging member, the first indicating member provided to the identified sheet finisher unit and the second indicating member provided in the vicinity of the identified sheet ejection tray, at or before a time that the sheet finishing begins.

12. The apparatus of claim 11, wherein the sheet finishing mode comprises at least one of a folding mode, a stitching mode and a stacker mode.

13. The apparatus of claim 12, wherein the folding mode comprises at least one of a multiple sheets letter folding mode and a Z folding mode.

14. The apparatus of claim 12, wherein the stitching mode comprises at least one of a saddle stitching mode and a side stitching mode.

15. The apparatus of claim 11, wherein the indicating control member lights the first indicating member after the sheet finisher unit which is used in the input sheet finishing mode is identified, and wherein the indicating control member lights the second indicating member after the sheet ejection tray which is used in the input sheet finishing mode is identified.

16. The apparatus of claim 11, wherein the indicating control member starts said lighting of at least one of the first indicating member and the second indicating member at a start of a sheet finishing job.

17. The apparatus of claim 11, wherein the indicating control member starts said lighting of at least one of the first indicating member and the second indicating member at a registration of a sheet finishing job.

* * * * *